US006658888B2

(12) United States Patent
Manohar et al.

(10) Patent No.: US 6,658,888 B2
(45) Date of Patent: Dec. 9, 2003

(54) METHOD FOR INCREASING EFFICIENCY OF A VAPOR COMPRESSION SYSTEM BY COMPRESSOR COOLING

(75) Inventors: Shailesh Manohar, Manchester, CT (US); Scott M. MacBain, Syracuse, NY (US); Tobias H. Sienel, Manchester, CT (US); Young Kyu Park, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/119,818

(22) Filed: Apr. 10, 2002

(65) Prior Publication Data

US 2003/0192338 A1 Oct. 16, 2003

(51) Int. Cl.[7] ..... F25B 1/00; F25B 43/00
(52) U.S. Cl. ..... 62/498; 62/115
(58) Field of Search ..... 62/498, 115, 490, 62/501, 502, 505, 510, 517

(56) References Cited

U.S. PATENT DOCUMENTS 4,332,137 A * 6/1982 Hayes, Jr. ..... 62/81
4,362,462 A 12/1982 Blotenberg
4,592,204 A 6/1986 Rice
5,245,836 A * 9/1993 Lorentzen et al. ..... 62/174
5,685,160 A * 11/1997 Abersfelder et al. ..... 62/114
5,730,216 A 3/1998 Viegas et al.
5,947,712 A 9/1999 Viegas et al.
6,298,677 B1 10/2001 Bujak et al.
6,418,735 B1 * 7/2002 Sienel ..... 62/115

FOREIGN PATENT DOCUMENTS

EP 0 908 688 A2 4/1999

* cited by examiner

*Primary Examiner*—Melvin Jones
(74) *Attorney, Agent, or Firm*—Carlson, Gaskey & Olds

(57) ABSTRACT

Efficiency of a transcritical vapor compression system is increased by compressor cooling. In one embodiment, a stream of cooling fluid accepts compressor motor heat. The heated cooling fluid merges with the fluid medium which accepts heat from the refrigerant in the gas cooler and exits the system, usefully transferring the heat out of the system. Additionally, as the refrigerant in the compressor is cooled, the density and the mass flow rate of the suction gas in the compressor is increased, increasing efficiency. Alternatively, an intercooler positioned between stages of a multi-stage compressor exchanges heat with the same fluid medium which accepts heat from the refrigerant in the gas cooler. After accepting heat from the refrigerant in the intercooler, the heated fluid medium exits the system, usefully transferring heat from the system.

17 Claims, 2 Drawing Sheets

METHOD FOR INCREASING EFFICIENCY OF A VAPOR COMPRESSION SYSTEM BY COMPRESSOR COOLING

BACKGROUND OF THE INVENTION

The present invention relates generally to a method for increasing the efficiency of a vapor compression system by removing heat in the compressor from the system with the heat accepted by the heat sink of the heat rejecting heat exchanger.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide to run transcritical, or above the critical point.

When a vapor compression system runs transcritical, the high side pressure of the refrigerant is typically high so that the refrigerant does not change phases from vapor to liquid while passing through the heat rejecting heat exchanger. Therefore, the heat rejecting heat exchanger operates as a gas cooler in a transcritical cycle, rather than as a condenser. The pressure of a subcritical fluid is a function of temperature under saturated conditions (where both liquid and vapor are present). However, the pressure of a transcritical fluid is a function of fluid density when the temperature is higher than the critical temperature.

In a prior vapor compression system, the heat generated by the compressor motor either is lost by being discharged to the ambient or superheats the suction gas in the compressor. If the heat is lost to the ambient, it is not transferred usefully, reducing system efficiency. Alternatively, if the heat superheats the suction gas in the compressor, the density and the mass flow rate of the refrigerant decrease, also decreasing system efficiency.

Another prior system has employed a tapping circuit which branches off from the heat sink of the heat rejecting heat exchanger to cool the compressor motor. After the cooling fluid in the tapping circuit accepts heat from the compressor motor, the tapping circuit returns to flow of the heat sink of the heat rejecting heat exchanger. A drawback to this system is that the cooling fluid which accepts heat from the compressor motor returns to the heat sink heated, lessening the ability of the cooling fluid to accept additional heat from the heat rejecting heat exchanger.

Two-stage compression systems employing an intercooler positioned between the compression stages has also been utilized to increase system efficiency. In a prior system, the refrigerant in the intercooler exchanges heat with the ambient or with a circuit of cooling fluid separate from the circuit of cooling fluid in the heat sink of the heat rejecting heat exchanger.

SUMMARY OF THE INVENTION

Efficiency of a vapor compression system is increased by usefully transferring heat in the compressor from the system with the heat accepted by the heat sink of the heat rejecting heat exchanger. In one embodiment, a stream of cooling fluid absorbs heat from the compressor motor. Preferably, the cooling fluid is water. The heated stream of cooling fluid merges with the heated fluid medium exiting the heat sink of the gas cooler and exits the system. The efficiency of the system is equal to the useful heat transferred divided by the work put into the cycle. As the heat of the compressor is usefully transferred out of the system rather than being lost to the ambient, system efficiency increases. Additionally, by removing the heat in the compressor motor, superheating of the suction gas in the compressor is reduced, increasing the density and mass flow rate of the refrigerant to further increase efficiency.

Alternatively, heat from the compressor motor is transferred to a secondary heat exchange medium, such as oil. The heated oil then transfers heat into the stream of cooling fluid for removal from the system.

In another embodiment, an intercooler is employed between compression stages for compressor cooling. After the fluid medium absorbs heat from the refrigerant in the gas cooler, the heated fluid medium travels to the intercooler to accept additional heat from the refrigerant in the intercooler. The heated fluid medium then usefully exits the system. As the heat in the intercooler is usefully transferred out of the system and is not lost, system efficiency is increased. Additionally, as the refrigerant exiting the intercooler is cooled, the mass flow rate and density of the refrigerant in the second stage of compression is increased, also increasing efficiency.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
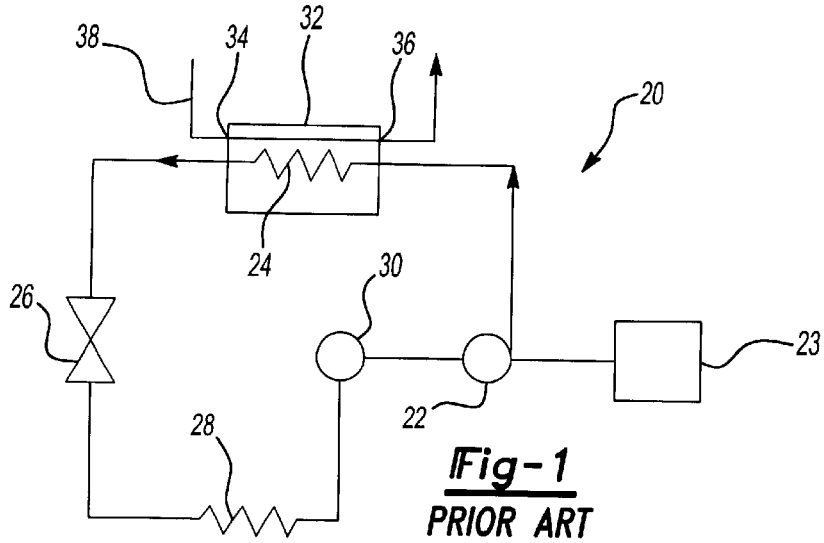
Fig-1 PRIOR ART
FIG. 1 illustrates a schematic diagram of a prior art vapor compression system.

FIG. 1 illustrates a schematic diagram of a prior art vapor compression system 20. The system 20 includes a compressor 22 with a motor 23, a first heat exchanger 24, an expansion device 26, a second heat exchanger 28, and a reversing valve 30 to reverse the flow of refrigerant circulating through the system 20. When operating in a heating mode, after the refrigerant exits the compressor 22 at high pressure and enthalpy, the refrigerant flows through the first heat exchanger 24, which acts as a gas cooler, and loses heat, exiting the first heat exchanger 24 at low enthalpy and high pressure. A fluid medium 38, such as water, flows through the heat sink 32 and accepts heat from the refrigerant passing through the first heat exchanger 24. The cooled fluid medium 38 enters the heat sink 32 at the heat sink inlet or return 34 and flows in a direction opposite to the direction of flow of the refrigerant. After accepting heat from the refrigerant, the heated fluid medium 38 exits at the heat sink outlet or supply 36. The refrigerant then passes through the expansion device 26, and the pressure drops. After expansion, the refrigerant flows through the second heat exchanger 28, which acts as an evaporator, and exits at a high enthalpy and low pressure. The refrigerant passes through the reversing valve 30 and then re-enters the compressor 22, completing the system 20. The reversing valve can reverse the flow of the refrigerant to change the system 20 from the heating mode to a cooling mode.

In a preferred embodiment of the invention, carbon dioxide is used as the refrigerant. While carbon dioxide is illustrated, other refrigerants may benefit from this invention. Because carbon dioxide has a low critical point, systems utilizing carbon dioxide as a refrigerant usually require the vapor compression system 20 to run transcritical.

Figure 2:
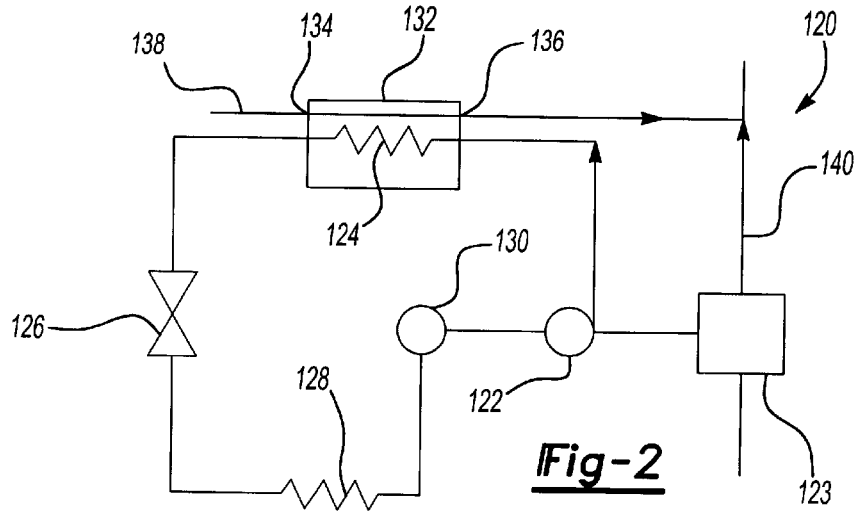
FIG. 2 illustrates a schematic diagram of a vapor compression system employing a stream of cooling fluid to cool the compressor.

FIG. 2 illustrates a vapor compression system 120 employing a stream of cooling fluid 140 to cool the compressor motor 123. Like numerals are increased by multiples of 100 to indicate like parts. The stream of cooling fluid 140 flows in or near the compressor motor 123, accepting heat generated by the compressor motor 123. Preferably, the stream of cooling fluid 140 is water. After accepting heat from the compressor motor 123, the stream of cooling fluid 140 merges with the heated fluid medium 138 exiting the heat sink 132 at the heat sink outlet 136. The merged flows of the heated cooling fluid 140 and the heated fluid medium 138 exit the vapor compression system 120, removing both the heat generated by the compressor motor 123 and the heat rejected by the refrigerant flowing through the first heat exchanger 124. The heated merged flows can then be used by the customer.

As the heat of the compressor motor 123 is usefully transferred out of the system 120 rather than being lost to the ambient, more useful heat of the system 220 is transferred. The efficiency of the system 120 is equal to the useful heat transferred divided by the work put into the system 120. As more useful heat is transferred, system 120 efficiency increases. Additionally, by accepting the heat in the compressor motor 123 with the cooling fluid 140, the superheating of the suction gas in the compressor 122 is reduced, increasing the density and mass flow rate of the refrigerant in the compressor 122, further increasing efficiency.

Figure 3:
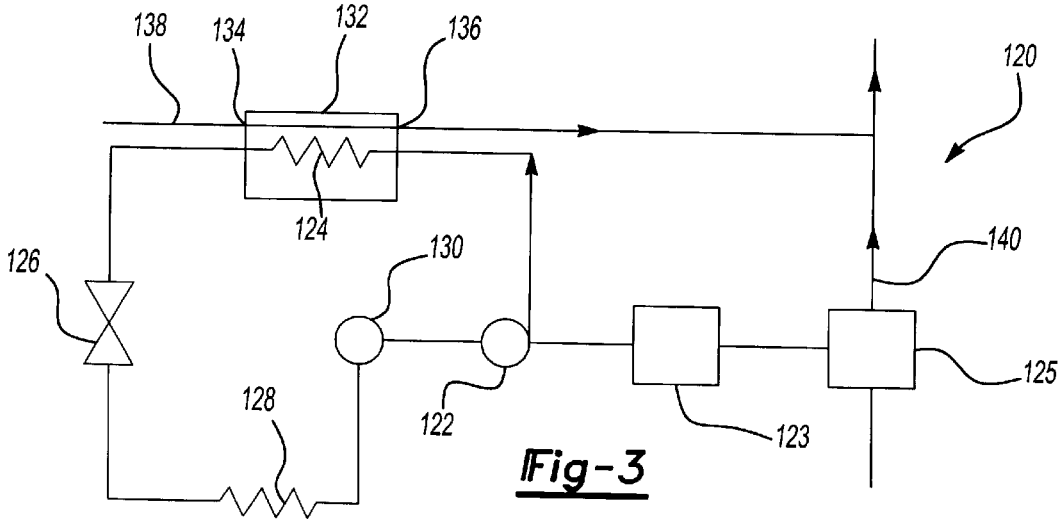
FIG. 3 illustrates a schematic diagram of a vapor compression system employing a secondary stream of cooling fluid to cool the compressor.

Alternatively, as shown in FIG. 3, the heat from the compressor motor 123 is transferred to a secondary heat exchange medium 125, such as oil. The stream of cooling fluid 140 accepts heat from the secondary heat exchange medium 125 and then merges with the heated fluid medium 138 to exit the system 120.

Figure 4:
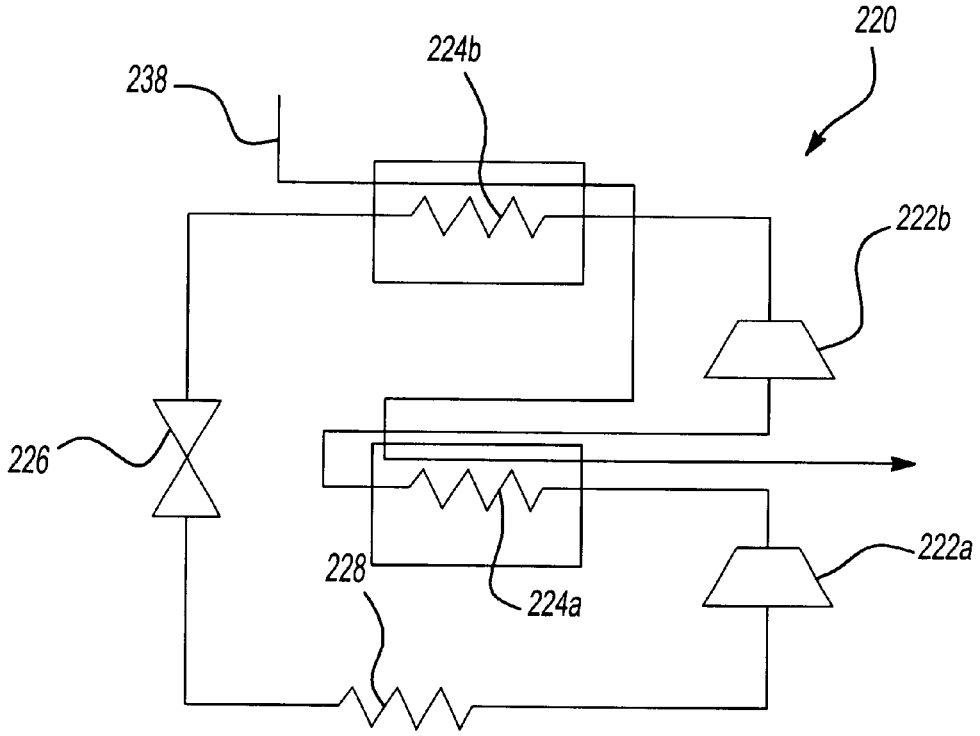
FIG. 4 illustrates a schematic diagram of a vapor compression system employing a stream of cooling fluid to cool both a gas cooler and an intercooler.

As shown in FIG. 4, system 220 efficiency is also increased by employing a multi-stage compression system 220. The vapor compression system 220 includes an expansion device 226, a second heat exchanger 228 or evaporator, either a single compressor with two stages or two single stage compressors 222*a* and 222*b*, an intercooler 224*a* positioned between the two stages of the compressors 222*a* and 222*b*, and a first heat exchanger or gas cooler 224*b*.

In the present invention, the refrigerant in the intercooler 224*a* exchanges heat with the same fluid medium 238 which flows through the heat sink 232 and exchanges heat with the refrigerant in the gas cooler 224*b*. After the fluid medium 238 accepts heat from the refrigerant in the gas cooler 224*b*, the heated fluid medium flows 238 to the intercooler 224*a* to accept additional heat from the refrigerant in the intercooler 224*a*. The heated fluid medium 238 then exits the system. As heat in the refrigerant in the intercooler 224*a* is usefully transferred to the fluid medium 238 and is not lost to the ambient, more useful heat is transferred from the system 220.

Additionally, as the refrigerant exiting the intercooler 224*a* is cooled, the mass flow rate and density of the refrigerant in the second stage of compression 222*b* is increased, also increasing efficiency.

Figure 5:
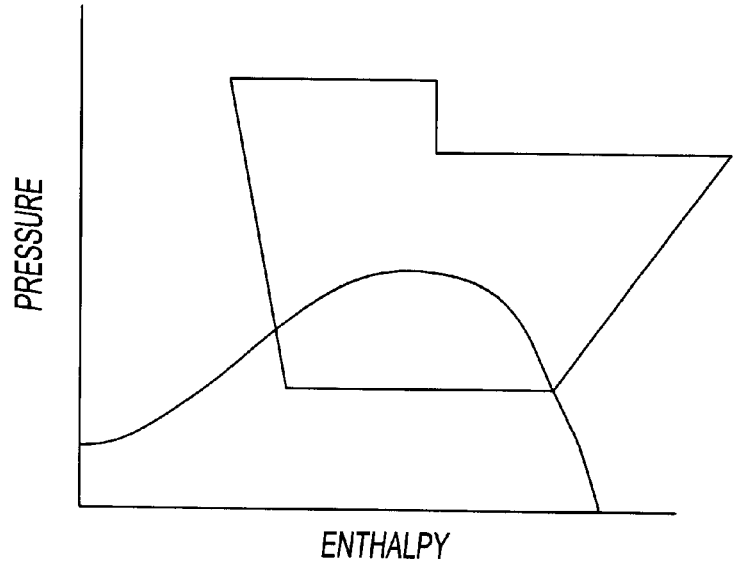
FIG. 5 illustrates a pressure-enthalpy diagram of FIG. 4.

FIG. 5 illustrates a pressure-enthalpy diagram of the vapor compression system 220. As shown, by employing the intercooler 224*a*, the discharge temperature of the second stage of the compressor 222*b* is lowered, increasing the reliability and life of the compressor 222*b*. For the same conditions, the combined work of the first 222*a* and the second 222*b* stages of compression is lower than it would be for single stage compression. This is shown by the decrease in the slope of entropy with respect to pressure after the refrigerant flows through the intercooler 224*b*.

Preferably, the volumetric displacement ratio between the first 222*a* and the second stages 222*b* of compression is two or greater. For a transcritical cycle, the efficiency of the system 220 is a function of the high side pressure. At a volumetric displacement ratio of two or greater, the discharge pressure from both stages 222*a* and 222*b* of compression are in the proper range for the optimal coefficient of performance.

The fluid medium 238 employed depends on the type of heating. For fan coil heating, the fluid medium is room air. Recirculating water is the fluid medium for hydronic space heating, and tap water is the fluid medium for domestic hot water.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A transcritical vapor compression system comprising:

a compression device to compress a refrigerant to a high pressure, heat from said compression device exiting said system with a first cooling medium;

a heat rejecting heat exchanger for cooling said refrigerant, heat from said refrigerant in said heat rejecting heat exchanger is rejected into said first cooling medium;

an expansion device for reducing said refrigerant to a low pressure; and a heat accepting heat exchanger for evaporating said refrigerant.

2. The system as recited in claim 1 wherein said heat from said compression device is rejected into a second cooling medium, and said second cooling medium merges with said first cooling medium for removal of said heat from said compression device from said system.

3. The system as recited in claim 2 wherein said heat from said compression device is rejected into a secondary exchange medium and heat in said secondary exchange medium is rejected into said second cooling medium.

4. The system as recited in claim 3 wherein said secondary exchange medium is oil.

5. The system as recited in claim 2 wherein said second cooling medium is water.

6. The system as recited in claim 2 wherein said heat from said compression device is generated by a compressor motor of said compression device.

7. The system as recited in claim 1 wherein said compression device includes a first stage, a second stage, and an intercooler located between said first stage and said second stage to further cool said refrigerant passing through said intercooler.

8. The system as recited in claim 7 wherein said first cooling medium accepts said heat from said refrigerant in said heat rejecting heat exchanger and accepts heat from said refrigerant in said intercooler.

9. The system as recited in claim 1 wherein said refrigerant is carbon dioxide.

10. A method of increasing capacity of a transcritical vapor compression system comprising the steps of:

compressing a refrigerant to a high pressure;

cooling said refrigerant by rejecting heat in said refrigerant into a first cooling medium;

expanding said refrigerant to a low pressure;

evaporating said refrigerant;

rejecting heat generated by the step of compressing into said first cooling medium; and removing said first cooling medium from said system.

11. The method as recited in claim 10 wherein the step of rejecting heat generated by the step of compressing into said first cooling medium includes rejecting heat generated by the step of compressing into a second cooling medium and merging said second cooling medium with said first cooling medium.

12. The method as recited in claim 11 wherein the step of rejecting heat from the step of compressing into said first cooling medium further includes rejecting heat into a secondary exchange medium, and rejecting said heat in said secondary exchange medium into said second cooling medium.

13. The method as recited in claim 12 wherein said secondary exchange medium is oil.

14. The method as recited in claim 11 wherein said second cooling medium is water.

15. The method as recited in claim 10 wherein said heat generated by the step of compressing is generated by a compressor motor.

16. The method as recited in claim 10 further including the steps of initially compressing said refrigerant and intercooling said refrigerant between the steps of initially compressing said refrigerant and compressing said refrigerant, wherein the step of rejecting heat from the step of compressing into said first cooling medium includes rejecting heat from said refrigerant in the step of intercooling into said first cooling medium.

17. The method as recited in claim 10 wherein said refrigerant is carbon dioxide.

* * * * *